US006946058B2

(12) United States Patent
Hu

(10) Patent No.: US 6,946,058 B2
(45) Date of Patent: Sep. 20, 2005

(54) METHOD AND SYSTEM FOR MANUFACTURING TISSUE PRODUCTS, AND PRODUCTS PRODUCED THEREBY

(75) Inventor: Sheng-hsin Hu, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 109 days.

(21) Appl. No.: 10/154,413

(22) Filed: May 23, 2002

(65) Prior Publication Data

US 2003/0111197 A1 Jun. 19, 2003

Related U.S. Application Data

(63) Continuation-in-part of application No. 10/025,383, filed on Dec. 19, 2001, now abandoned.

(51) Int. Cl.[7] ..... D21H 11/00; D21H 13/00

(52) U.S. Cl. ..... 162/129; 162/111; 162/113; 162/179; 162/187

(58) Field of Search ..... 162/129, 130, 162/179, 55, 109, 111, 123, 187, 112, 113

(56) References Cited

U.S. PATENT DOCUMENTS

| | | | | |
|---|---|---|---|---|
| 3,085,927 | A | | 4/1963 | Pesch |
| 3,598,696 | A | | 8/1971 | Beck |
| 3,695,985 | A | | 10/1972 | Brock et al. |
| 3,791,917 | A | | 2/1974 | Bolton, III |
| 3,903,342 | A | | 9/1975 | Roberts, Jr. |
| 3,953,638 | A | | 4/1976 | Kemp |
| 3,997,647 | A | | 12/1976 | Lassen |
| 4,075,382 | A | | 2/1978 | Chapman et al. |
| 4,100,017 | A | | 7/1978 | Flautt, Jr. |
| 4,113,911 | A | | 9/1978 | LaFitte et al. |
| 4,145,464 | A | | 3/1979 | McConnell et al. |
| 4,166,001 | A | | 8/1979 | Dunning et al. |
| 4,196,245 | A | | 4/1980 | Kitson et al. |
| 4,207,367 | A | | 6/1980 | Baker, Jr. |
| 4,225,382 | A | | 9/1980 | Kearney et al. |
| 4,239,792 | A | | 12/1980 | Ludwa |
| 4,256,111 | A | | 3/1981 | Lassen |
| 4,287,251 | A | | 9/1981 | King et al. |
| 4,298,649 | A | | 11/1981 | Meitner |
| 4,300,981 | A | | 11/1981 | Carstens |
| 4,326,000 | A | | 4/1982 | Roberts, Jr. |
| 4,377,615 | A | | 3/1983 | Suzuki et al. |
| 4,436,780 | A | | 3/1984 | Hotchkiss et al. |
| 4,445,974 | A | | 5/1984 | Stenberg |
| 4,469,735 | A | | 9/1984 | Trokhan |
| 4,482,429 | A | * | 11/1984 | Klowak ..... 162/111 |
| 4,517,054 | A | | 5/1985 | Hujàla et al. |
| 4,537,822 | A | | 8/1985 | Nanri et al. |
| 4,548,856 | A | | 10/1985 | Khan et al. |
| 4,610,915 | A | | 9/1986 | Crenshaw et al. |
| 4,614,566 | A | | 9/1986 | Koponen et al. |
| 4,618,524 | A | | 10/1986 | Groitzsch et al. |
| 4,744,866 | A | | 5/1988 | Koponen et al. |
| 4,781,793 | A | | 11/1988 | Halme |
| 4,816,320 | A | | 3/1989 | St. Cyr |
| 4,853,086 | A | | 8/1989 | Graef |
| 4,885,202 | A | | 12/1989 | Lloyd et al. |
| 4,888,092 | A | | 12/1989 | Prusas et al. |
| 4,897,155 | A | | 1/1990 | Koteles |
| 4,946,557 | A | | 8/1990 | Svending |
| 4,964,954 | A | | 10/1990 | Johansson |
| 4,964,955 | A | | 10/1990 | Lamar et al. |
| 4,983,258 | A | | 1/1991 | Maxham |
| 5,002,633 | A | | 3/1991 | Maxham |
| 5,011,741 | A | | 4/1991 | Hoffman |
| 5,048,589 | A | | 9/1991 | Cook et al. |
| 5,087,324 | A | | 2/1992 | Awofeso et al. |
| 5,127,994 | A | | 7/1992 | Johansson |
| 5,129,988 | A | | 7/1992 | Farrington, Jr. |
| 5,133,832 | A | | 7/1992 | Gilkey |
| 5,137,599 | A | | 8/1992 | Maxham |
| 5,192,388 | A | | 3/1993 | Schöllkopf et al. |
| 5,228,954 | A | | 7/1993 | Vinson et al. |
| 5,336,373 | A | | 8/1994 | Scattolino et al. |
| 5,397,435 | A | | 3/1995 | Ostendorf et al. |
| 5,399,412 | A | | 3/1995 | Sudall et al. |
| 5,409,572 | A | * | 4/1995 | Kershaw et al. ..... 162/109 |
| 5,468,348 | A | | 11/1995 | Blackledge et al. |
| 5,468,396 | A | | 11/1995 | Allen et al. |
| 5,494,554 | A | | 2/1996 | Edwards et al. |
| 5,501,768 | A | | 3/1996 | Hermans et al. |
| 5,510,001 | A | | 4/1996 | Hermans et al. |
| 5,527,432 | A | | 6/1996 | Leuthold et al. |
| 5,529,665 | A | | 6/1996 | Kaun |
| 5,543,202 | A | | 8/1996 | Clark et al. |
| 5,582,681 | A | | 12/1996 | Back et al. |
| 5,591,309 | A | | 1/1997 | Rugowski et al. |
| 5,607,551 | A | | 3/1997 | Farrington, Jr. et al. |

(Continued)

FOREIGN PATENT DOCUMENTS

| | | |
|---|---|---|
| EP | 0568404 A1 | 11/1993 |
| EP | 0631014 A1 | 12/1994 |
| EP | 0824157 | 2/1998 |
| WO | WO 9600811 | 1/1996 |
| WO | WO 9715711 | 5/1997 |
| WO | WO 9823813 | 6/1998 |
| WO | WO 9823814 | 6/1998 |

OTHER PUBLICATIONS

Journa Lumiainen, "Refining of chemical pulp", 9 pages. No date.

*Primary Examiner*—Mark Halpern
(74) *Attorney, Agent, or Firm*—Dority & Manning, P.A.

(57) ABSTRACT

A process and product of making a tissue product is provided. For example, the method can comprise (a) providing a first papermaking furnish containing refined softwood fibers; (b) providing a second papermaking furnish containing hardwood fibers; (c) incorporating the first and second papermaking furnishes into a tissue web such that the tissue web has a hardwood layer and a softwood layer; (d) contacting the tissue web with a drying surface so that the hardwood layer is disposed adjacent thereto; and (e) removing the tissue web from the drying surface with a creping blade at a creping pocket angle of less than about 82 degrees.

15 Claims, 4 Drawing Sheets

U.S. PATENT DOCUMENTS 5,616,207 A 4/1997 Sudall et al.
5,620,565 A 4/1997 Lazorisak et al.
5,667,636 A 9/1997 Engel et al.
5,730,839 A 3/1998 Wendt et al.
5,785,813 A 7/1998 Smith et al.
5,830,317 A 11/1998 Vinson et al.
5,830,320 A 11/1998 Park et al.
5,834,095 A 11/1998 Dutkiewicz et al.
5,853,539 A 12/1998 Smith et al.
5,858,021 A * 1/1999 Sun et al. ..... 8/125
5,993,602 A 11/1999 Smith et al.
6,001,218 A 12/1999 Hsu et al.
6,017,417 A 1/2000 Wendt et al.
6,024,834 A 2/2000 Horton, Jr. et al.
6,027,610 A 2/2000 Back et al.
6,039,839 A * 3/2000 Trokhan et al. ..... 162/116
6,074,527 A 6/2000 Hsu et al.
6,080,266 A 6/2000 Horton, Jr. et al.
6,156,157 A 12/2000 Schroeder et al.
6,207,012 B1 3/2001 Oriaran et al.
6,248,210 B1 6/2001 Edwards et al.
6,296,736 B1 10/2001 Hsu et al.
6,372,085 B1 4/2002 Hsu et al.
6,387,210 B1 5/2002 Hsu et al.
6,391,154 B1 5/2002 Nygärd et al.
6,413,363 B1 7/2002 Hsu et al.
6,511,579 B1 1/2003 Edwards et al.
2002/0162635 A1 11/2002 Hsu

* cited by examiner

METHOD AND SYSTEM FOR MANUFACTURING TISSUE PRODUCTS, AND PRODUCTS PRODUCED THEREBY

RELATED APPLICATIONS

This application is a continuation-in-part of U.S. application Ser. No. 10/025,383, which was filed on Dec. 19, 2001, now abandoned.

BACKGROUND OF THE INVENTION

The use of debonders/softening agents in facial and bath tissue is a common practice in the industry. It has been shown that adding such chemicals to the wet end of a tissue machine reduces adhesion to the drying surface. Generally speaking, debonders soften by interfering with fiber-to-fiber bonding and often reduce dryer adhesion when used in a creping process. The reduced adhesion results in less efficient sheet break-up and coarser creping. This reduction in sheet break-up takes away from the total softness of the tissue, which is contrary to the purpose for which the softener was added.

Consequently, various other techniques have been developed to counteract these problems. For example, U.S. Pat. No. 5,730,839 to Wendt, et al. describes an especially soft tissue produced using a closed creping pocket in conjunction with a softening agent. However, in some instances, the softness is enhanced to such an extent that slough is generated. Sloughing may be described generally as the loss of paper particles from the surface of the paper due to surface abrasion. Many consumers react negatively to paper that exhibits a high degree of sloughing.

Therefore, it would be desirable to provide a process, system and resulting product showing capable of providing a high degree of softness and strength, with reduced amounts of sloughing.

SUMMARY OF THE INVENTION

In accordance with one embodiment of the present invention, a method of manufacturing a tissue product is disclosed. The method comprises (a) providing a first papermaking furnish containing softwood fibers refined at an energy greater than about 1.5 horsepower-day per ton; (b) providing a second papermaking furnish containing hardwood fibers; (c) incorporating the first and second papermaking furnishes into a tissue web such that the tissue web has a hardwood layer and a softwood layer; (d) contacting the tissue web with a drying surface so that the hardwood layer is disposed adjacent thereto; and (e) removing the tissue web from the drying surface with a creping blade at a creping pocket angle of less than about 82 degrees.

In some embodiments, the hardwood layer and the softwood layer are formed using a multi-layered headbox.

Moreover, if desired, the energy with which the softwood fibers are refined can be greater than about 3.0 horsepower-day per ton, and in some embodiments, greater than about 6.0 horsepower-day per ton. Also, the creping blade angle can be less than about 80 degrees, in some embodiments less than about 78 degrees, and in some embodiments, less than about 75 degrees.

If desired, a debonder may also be applied to the hardwood layer to improve the softness of the tissue product. When the hardwood layer defines an outer surface of the resulting tissue product, such a debonder may be particularly useful in softening the surface of the tissue exposed to a user.

Other features and aspects of the present invention are discussed in greater detail below.

BRIEF DESCRIPTION OF THE DRAWINGS

A full and enabling disclosure of this invention, including the best mode shown to one of ordinary skill in the art, is set forth in this specification.

DETAILED DESCRIPTION OF THE INVENTION

Figure 1:
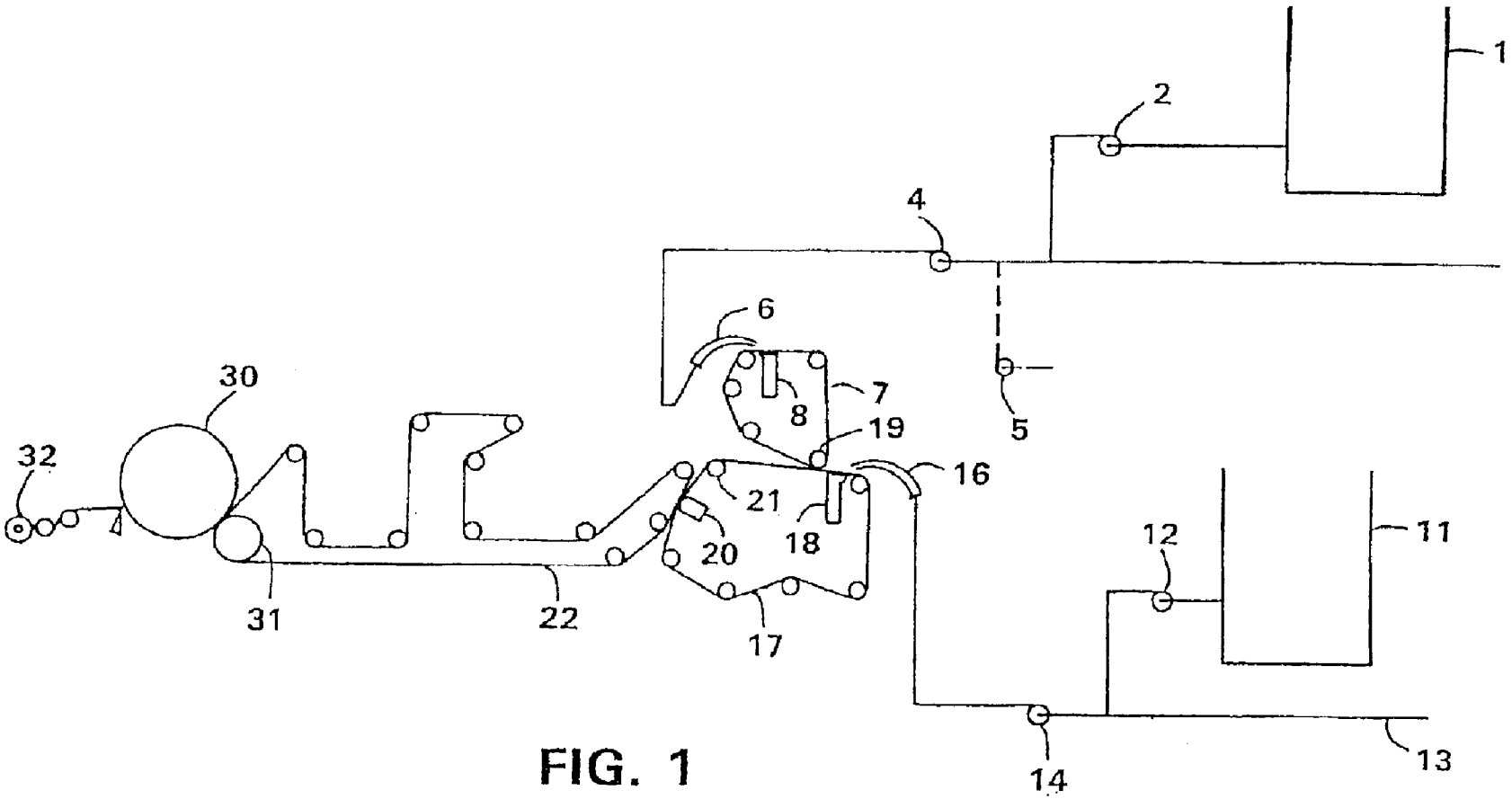
FIG. 1 is a schematic flow diagram of one embodiment of a papermaking process that can be used in the present invention.

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention, which broader aspects are embodied in the exemplary constructions.

Surprisingly, it has been discovered that incorporating heavily refined fibers (i.e., greater than about 1.5 horsepower-day per ton) into a tissue web and then creping the web using closed pocket creping can form a tissue that is relatively soft, but yet generates minimal amounts of slough. In some embodiments, for example, heavily refined softwood fibers are used in at least one layer of a multi-layered web. In one embodiment, a two-layered tissue web is formed in which one layer is formed from hardwood fibers and another layer is formed from heavily refined, softwood fibers. During formation, the hardwood layer can be placed adjacent to the drying surface and closed pocket creped. In another embodiment, a three-layered tissue web is formed in which one or both outer layers are formed from hardwood fibers and the center layer is formed from heavily refined softwood fibers. Again, the hardwood layer is placed adjacent to the drying surface during formation and closed pocket creped. By using a combination of refined softwood fibers and closed pocket creping, it has been discovered that the resulting tissue product can be imparted with softness without generating a substantial amount of slough.

As used herein, the term "layer" generally refers to a single thickness, course, stratum, or fold that may lay on its own, or that may lay over or under another. Further, the term "ply" can refer to a material produced from a headbox having one or more layers and a material produced by pressing together two or more wet webs that are each formed from a headbox having a single layer.

As used herein, a "tissue product" generally refers to various tissue products, such as facial tissue, bath tissue, paper towels, napkins, and the like. Normally, the basis weight of a tissue product of the present invention is less than about 80 grams per square meter (gsm), and in some embodiments less than about 60 gsm, and in other embodiments between about 10 to about 60 gsm. The basis weight for all examples provided below is 30 gsm.

A wide variety of cellulosic fibers may generally be employed in the process of the present invention. Illustrative cellulosic fibers that may be employed in the practice of the invention include, but are not limited to, wood and wood products, such as wood pulp fibers (e.g., softwood or hardwood pulp fibers); non-woody paper-making fibers from cotton, from straws and grasses, such as rice and esparto, from canes and reeds, such as bagasse, from bamboos, form stalks with bast fibers, such as jute, flax, kenaf, cannabis, linen and ramie, and from leaf fibers, such as abaca and sisal. It is also possible to use mixtures of one or more cellulosic fibers. It is generally desired that the cellulosic fibers used herein be wettable. Suitable cellulosic fibers include those that are naturally wettable. However, naturally non-wettable fibers can also be used.

Softwood sources include trees sources, such as pines, spruces, and firs and the like. Hardwood sources, such as oaks, eucalyptuses, poplars, beeches, and aspens, may be used, but this list is by no means exhaustive of all the hardwood sources that may be employed in the practice of the invention. Hardwood fiber sources generally contain fibers of a shorter length than softwood sources. Many times, sloughing occurs when shorter fibers flake or fall from the outer hardwood layers of multi-layered tissues.

Fibers from different sources of wood exhibit different properties. Hardwood fibers, for example, tend to show high degrees of "fuzziness" or softness when placed on the exterior surface of a tissue product, such as a bathroom tissue. In many embodiments of the invention, a first furnish comprising a strength layer is employed. This first furnish may be a softwood, for example. The average fiber length of a softwood fiber typically is about two to four times longer than a hardwood fiber. In the practice of the present invention, it is desired that the cellulosic fibers be used in a form wherein the cellulosic fibers have already been prepared into a pulp. As such, the cellulosic fibers will be presented substantially in the form of individual cellulosic fibers, although such individual cellulosic fibers may be in an aggregate form such as a pulp sheet. This is in contrast with untreated cellulosic forms such as wood chips or the like. Thus, the current process is generally a post-pulping, cellulosic fiber separation process as compared to other processes that may be used for high-yield pulp manufacturing processes.

The preparation of cellulosic fibers from most cellulosic sources results in a heterogeneous mixture of cellulosic fibers. The individual cellulosic fibers in the mixture exhibit a broad spectrum of values for a variety of properties such as length, coarseness, diameter, curl, color, chemical modification, cell wall thickness, fiber flexibility, and hemicellulose and/or lignin content. As such, seemingly similar mixtures of cellulosic fibers prepared from the same cellulosic source may exhibit different mixture properties, such as freeness, water retention, and fines content because of the difference in actual cellulosic fiber make-up of each mixture or slurry.

In general, the cellulosic fibers may be used in the process of the present invention in either a dry or a wet state. However, it may be desirable to prepare an aqueous mixture comprising the cellulosic fibers wherein the aqueous mixture is agitated, stirred, or blended to effectively disperse the cellulosic fibers throughout the water.

The cellulosic fibers are typically mixed with an aqueous solution wherein the aqueous solution beneficially comprises at least about 30 weight percent water, suitably about 50 weight percent water, more suitably about 75 weight percent water, and most suitably about 100 weight percent water. When another liquid is employed with the water, such other suitable liquids include methanol, ethanol, isopropanol, and acetone. However, the use or presence of such other non-aqueous liquids may impede the formation of an essentially homogeneous mixture such that the cellulosic fibers do not effectively disperse into the aqueous solution and effectively or uniformly mix with the water. Such a mixture should generally be prepared under conditions that are sufficient for the cellulosic fibers and water to be effectively mixed together. Generally, such conditions will include using a temperature that is between about 10° C. and about 100° C. In general, cellulosic fibers are prepared by pulping or other preparation processes in which the cellulosic fibers are present in an aqueous solution.

Papermaking Processes

A tissue product made in accordance with the present invention can generally be formed according to a variety of papermaking processes known in the art. In fact, any process capable of making a tissue web can be utilized in the present invention. For example, a papermaking process of the present invention can utilize wet-pressing, creping, through-air-drying, creped through-air-drying, uncreped through-air-drying, single recreping, double recreping, calendering, embossing, air laying, as well as other steps in processing the tissue web. For instance, some suitable papermaking processes are described in U.S. Pat. No. 5,129,988 to Farrington, Jr.; U.S. Pat. No. 5,494,554 to Edwards, et al.; and U.S. Pat. No. 5,529,665 to Kaun, which are incorporated herein in their entirety by reference thereto for all purposes.

In this regard, various embodiments of a method for forming a multi-layered paper web will now be described in more detail. Referring to FIG. 1, a method of making a wet-pressed tissue in accordance with one embodiment of the present invention is shown, commonly referred to as couch forming, wherein two wet web layers are independently formed and thereafter combined into a unitary web. To form the first web layer, a specified fiber (either hardwood or softwood) is prepared in a manner well known in the papermaking arts and delivered to the first stock chest 1, in which the fiber is kept in an aqueous suspension. A stock pump 2 supplies the required amount of suspension to the suction side of the fan pump 4. If desired, a metering pump 5 can supply an additive (e.g., latex, reactive composition, etc.) into the fiber suspension. Additional dilution water also is mixed with the fiber suspension.

The entire mixture of fibers is then pressurized and delivered to the headbox 6. The aqueous suspension leaves the headbox 6 and is deposited on an endless papermaking fabric 7 over the suction box 8. The suction box is under vacuum that draws water out of the suspension, thus forming the first layer. In this example, the stock issuing from the headbox 6 would be referred to as the "air side" layer, that layer eventually being positioned away from the dryer surface during drying.

The forming fabric can be any forming fabric, such as fabrics having a fiber support index of about 150 or greater. Some suitable forming fabrics include, but are not limited to, single layer fabrics, such as the Appleton Wire 94M available from Albany International Corporation, Appleton Wire Division, Menasha, Wis.; double layer fabrics, such as the Asten 866 available from Asten Group, Appleton, Wis.; and triple layer fabrics, such as the Lindsay 3080, available from Lindsay Wire, Florence, Miss.

The consistency of the aqueous suspension of papermaking fibers leaving the headbox can be from about 0.05 to about 2%, and in one embodiment, about 0.2%. The first headbox 6 can be a layered headbox with two or more layering chambers which delivers a stratified first wet web layer, or it can be a monolayered headbox which delivers a blended or homogeneous first wet web layer.

To form the second web layer, a specified fiber (either hardwood or softwood) is prepared in a manner well known in the papermaking arts and delivered to the second stock chest 11, in which the fiber is kept in an aqueous suspension. A stock pump 12 supplies the required amount of suspension to the suction side of the fan pump 14. A metering pump 5 can supply additives (e.g., latex, reactive composition, etc.) into the fiber suspension as described above. Additional dilution water 13 is also mixed with the fiber suspension. The entire mixture is then pressurized and delivered to the headbox 16. The aqueous suspension leaves the headbox 16 and is deposited onto an endless papermaking fabric 17 over the suction box 18. The suction box is under vacuum that draws water out of the suspension, thus forming the second wet web. In this example, the stock issuing from the headbox 16 is referred to as the "dryer side" layer as that layer will be in eventual contact with the dryer surface. Suitable forming fabrics for the forming fabric 17 of the second headbox include those forming fabrics previously mentioned with respect to the first headbox forming fabric.

After initial formation of the first and second wet web layers, the two web layers are brought together in contacting relationship (couched) while at a consistency of from about 10 to about 30%. Whatever consistency is selected, it is typically desired that the consistencies of the two wet webs be substantially the same. Couching is achieved by bringing the first wet web layer into contact with the second wet web layer at roll 19.

After the consolidated web has been transferred to the felt 22 at vacuum box 20, dewatering, drying and creping of the consolidated web is achieved in the conventional manner. More specifically, the couched web is further dewatered and transferred to a dryer 30 (e.g., Yankee dryer) using a pressure roll 31, which serves to express water from the web, which is absorbed by the felt, and causes the web to adhere to the surface of the dryer. The web is then dried, optionally creped and wound into a roll 32 for subsequent converting into the final creped product.

Figure 2:
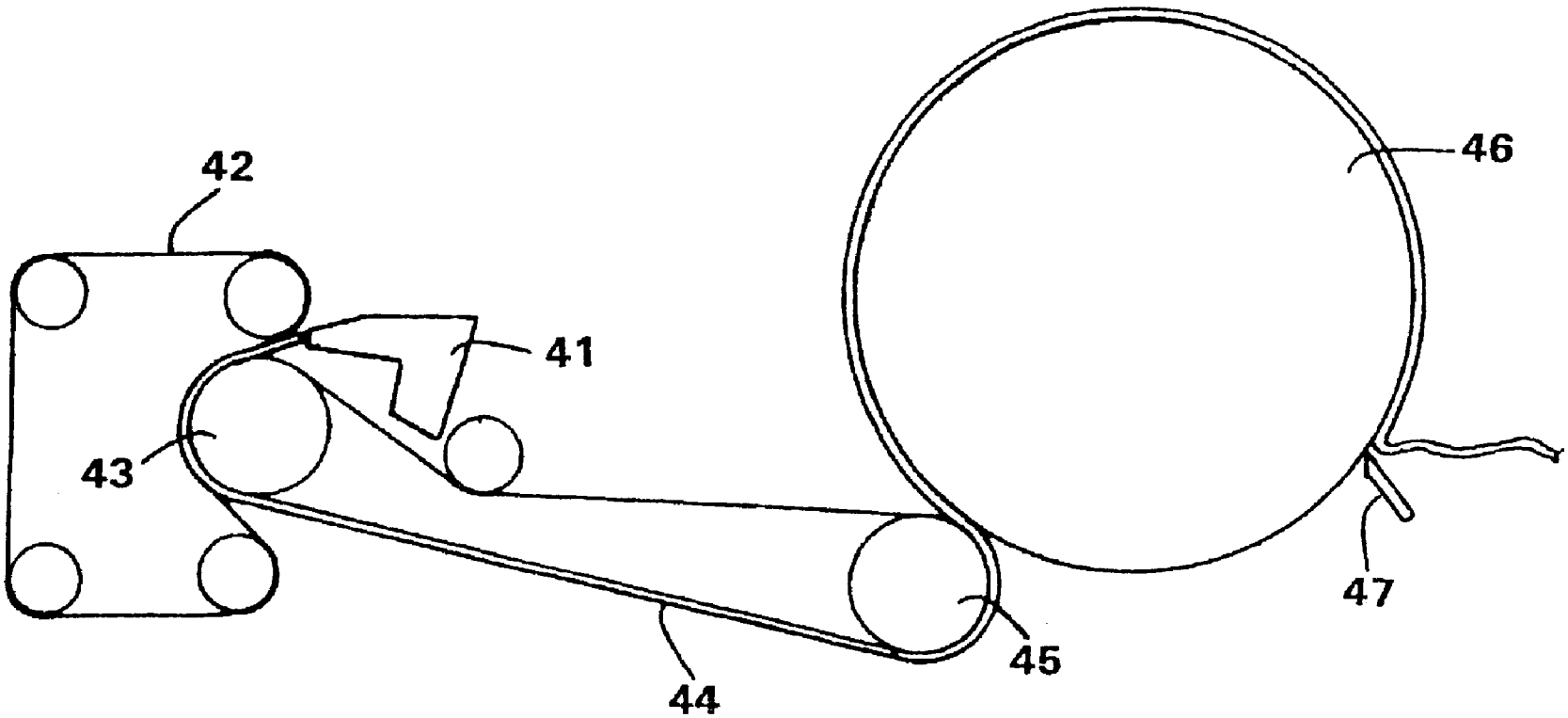
FIG. 2 is a schematic flow diagram of another embodiment of a papermaking process that can be used in the present invention.

FIG. 2 is a schematic flow diagram of another embodiment of a papermaking process that can be used in the present invention. For instance, a layered headbox 41, a forming fabric 42, a forming roll 43, a papermaking felt 44, a press roll 45, a Yankee dryer 46, and a creping blade 47 are shown. Also shown, but not numbered, are various idler or tension rolls used for defining the fabric runs in the schematic diagram, which may differ in practice. In operation, a layered headbox 41 continuously deposits a layered stock jet between the forming fabric 42 and the felt 44, which is partially wrapped around the forming roll 43. Water is removed from the aqueous stock suspension through the forming fabric 42 by centrifugal force as the newly-formed web traverses the arc of the forming roll. As the forming fabric 42 and felt 44 separate, the wet web stays with the felt 44 and is transported to the Yankee dryer 46.

At the Yankee dryer 46, the creping chemicals are continuously applied on top of the existing adhesive in the form of an aqueous solution. The solution is applied by any convenient means, such as using a spray boom that evenly sprays the surface of the dryer with the creping adhesive solution. The point of application on the surface of the dryer 46 is immediately following the creping doctor blade 47, permitting sufficient time for the spreading and drying of the film of fresh adhesive.

Figure 3:
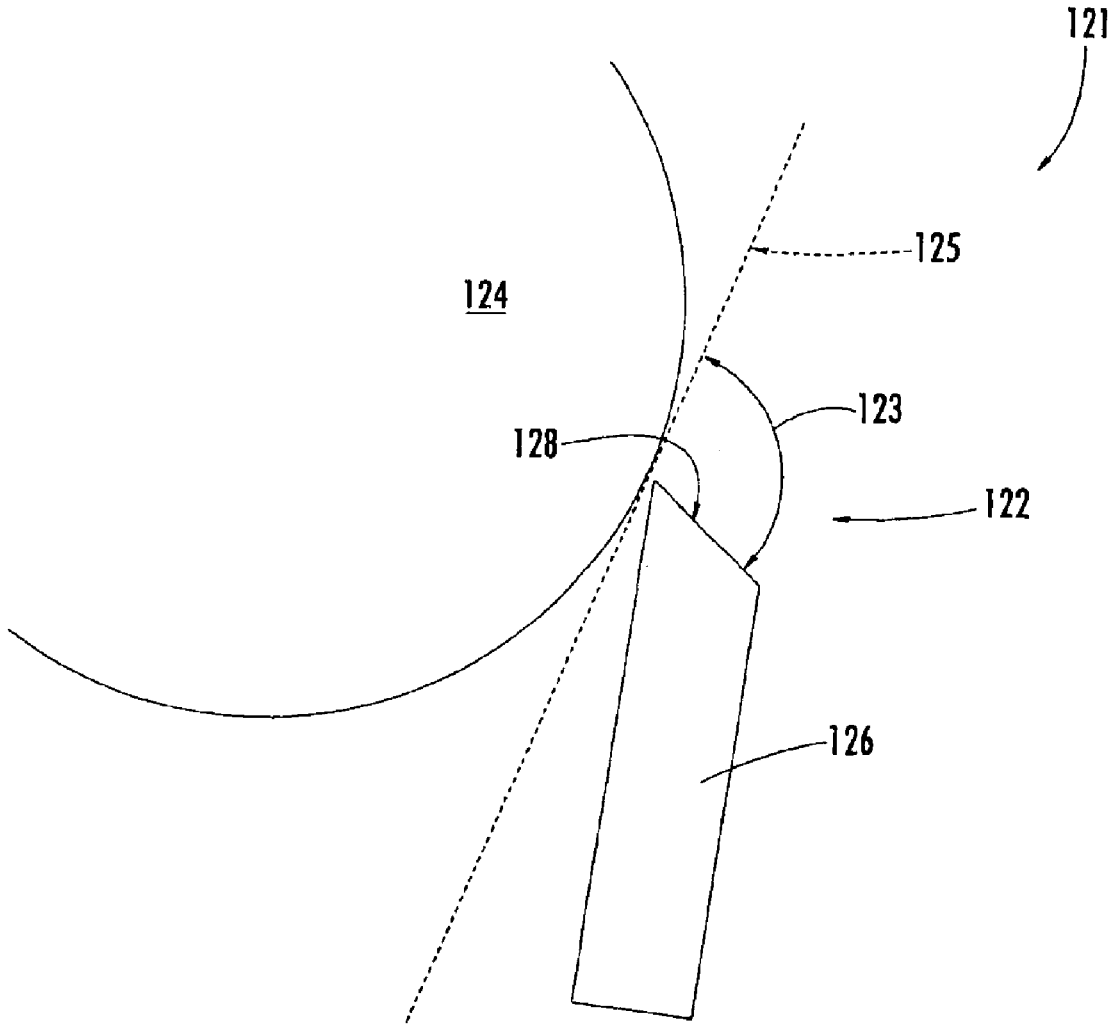
FIG. 3 is a schematic representation of the creping pocket, illustrating the creping geometry.

FIG. 3 is a schematic view illustrating a typical creping operation, showing the creping geometry 121. The creping pocket 122 forms a creping pocket angle 123. This creping pocket angle 123 is formed by the angle between a tangent line 125 to the Yankee dryer 124 at the point of contact with the creping blade 126, and the surface 128 of the creping blade 126 against which the sheet impacts.

The creping pocket angle 123 is schematically indicated by the double arrow in FIG. 3. The angle varies depending upon the particular tissue product being formed, and may be adjusted to achieve certain desired results. The closed pocket creping angle 123 can be less than about 82°, in some embodiments less than about 80°, in some embodiments less than about 78°, and in some embodiments, less than about 75°. In general, lower angles cause more energy to be transferred to the paper web (not shown). However, the increased energy of a lowered creping pocket angle 123 sometimes causes a failure at the web/adhesive interface resulting in folding of the sheet (as demonstrated for example by a coarse crepe), rather than compressive debonding which would yield a less dense, softer product. The adhesion derived from this invention allows the increased energy derived from closed pocket creping to result in a failure in the adhesive layer itself. This facilitates compressive debonding of the sheet, yielding a less dense and softer sheet. Various techniques for closed pocket creping are also described in U.S. Pat. No. 5,730,839 to Wendt, et al., which is incorporated herein in its entirety by reference thereto for all purposes.

The crepe that results from the application of the invention may provide a combination of both coarse and fine structures. The invention may employ a fine crepe structure superimposed upon an underlying coarse crepe structure. Thus, the fine structure confirms the effective break-up of the sheet while the underlying coarse structure enhances the perception of substance.

In the application of the invention, the tissue or tissue product is manufactured and assembled with a layered structure. That is, a two or three layer structure may be employed. More than three layers can also be used. If the structure is to be a two-layered structure, then the softwood layer may only be refined, and the hardwood layer may not be refined. In general, the hardwood layer is against the dryer side and is creped against a doctor blade. Where a three-layered structure is employed, the two outside layers may be hardwood layers, while the inside layer may be a softwood layer (i.e. such as refined softwood fiber).

Refining of Fiber

Refining or beating of chemical pulps is the mechanical treatment and modification of fibers. Refining improves the bonding ability of fibers so that they form a strong and smooth paper sheet with good printing properties. Refining may be applied to only fibers from one layer, such as only upon softwood fibers located in a center layer, or only upon a layer that contacts an air side (i.e., not the dryer surface) during web formation.

A common refining or beating method is to treat fibers in the presence of water with metallic bars. The plates or fillings are grooved so that the bars that treat fibers and the grooves between bars allow fiber transportation through the refining machine. Such machines are known in the paper-making art. Most refining is performed during a stage when bar edges give mechanical treatment and friction between fibers gives fiber-to-fiber treatment inside the floc. This stage continues until the leading edges reach the tailing edges of the opposite bars. After the edge-to-surface stage, the fiber bundle (floc) is still pressed between the flat bar surfaces until the tailing edge of the rotor bar has passed the tailing edge of the stator bar.

The refining results depend to a great extent on the stapling of fibers on the bar edges and on the behavior of the fibers in the floc during refining impacts. Long-fibered softwood pulps easily get stapled on the bar edges and build strong flocs that do not easily break in refining. Decreased gap clearance hastens refining degree change and increases fiber cutting. On the contrary, it is usually more difficult to get short-fibered hardwood pulps stapled on the bar edges, and such hardwood fibers may build weak flocs that easily break in refining. Decreased gap clearance means slower refining, in general.

The common feature of low-consistency refining theories is that the total or gross applied refiner power is divided into two components. The net refining power, which is the fiber-treating component, is the total absorbed refiner power minus no load power or idling power. The no load power is measured with water flowing through the running refiner, and the gap clearance is as narrow as possible without fillings or plates touching each other or any substantial increase in power. Total power, of course, depends on the actual running situation. Often the refining resistance of fibers determines the maximum loadability, but the ultimate limit is set by the torque moment of the refiner. This torque-based maximum total power increases linearly as the rotation speed of the refiner increases.

The amount of refining is described by the net energy input or the amount of net energy transferred to fibers. It is a practical way to evaluate the conditions inside the refiner. Conventionally, fibers were only subjected to refining with less than 1.5 horsepower-day per ton (HPD/T) to maintain a sufficient balance between strength and softness. Now, it has been discovered that using fibers refined to an even greater extent (e.g., greater than about 1.5 HPD/T) may improve tissue strength while, at the same time, produce a superior tissue product with strength, softness and less slough when used in conjunction with closed pocket creping. Thus, fibers employed in the present invention may be refined with an energy of greater than about 1.5 horsepower-day per ton (HPD/T), in some embodiments greater than about 3.0 HPD/T, and in some embodiments, greater than about 6.0 HPD/T.

Stiffness

Stiffness (or softness) was ranked on a scale from 0 (described as pliable/flexible) to 16 (described as stiff/rigid). Twelve (12) panelists were asked to consider the amount of pointed, rippled or cracked edges or peaks felt from the sample while turning in your hand. The panelists were instructed to place two tissue samples flat on a smooth tabletop. The tissue samples overlapped one another by 0.5 inches (1.27 centimeters) and were flipped so that opposite sides of the tissue samples were represented during testing. With forearms/elbows of each panelist resting on the table, they placed their open hand, palm down, on the samples. Each was instructed to position their hand so their fingers were pointing toward the top of the samples, approximately 1.5 inches (approximately 3.81 centimeters) from the edge. Each panelist moved their fingers toward their palm with little or no downward pressure to gather the tissue samples. They gently moved the gathered samples around in the palm of their hand approximately 2 to 3 turns. The rank assigned by each panelist for a given tissue sample was then averaged and recorded.

Tensile (GMT) Strength Test Method

Tensile strength was reported as "GMT" (grams per 3 inches of a sample), which is the geometric mean tensile strength and is calculated as the square root of the product of MD tensile strength and CD tensile strength. MD and CD tensile strengths were determined using a MTS/Sintech tensile tester (available from the MTS Systems Corp., Eden Prairie, Minn.). Tissue samples measuring 3 inch wide were cut in both the machine and cross-machine directions. For each test, a sample strip was placed in the jaws of the tester, set at a 4-inch gauge length for facial tissue and 2-inch gauge length for bath tissue. The crosshead speed during the test was 10 inches/minute. The tester was connected with a computer loaded with data acquisition system; e.g., MTS TestWork for windows software. Readings were taken directly from a computer screen readout at the point of rupture to obtain the tensile strength of an individual sample.

Slough Measurement Methods and Apparatus

To determine the abrasion resistance or tendency of fibers to be rubbed from the web, samples were measured by abrading the tissue specimens by way of the following method. This test measures the resistance of tissue material to abrasive action when the material is subjected to a horizontally reciprocating surface abrader. All samples were conditioned at about 23° C. and about 50% relative humidity for a minimum of 4 hours.

Figure 4:
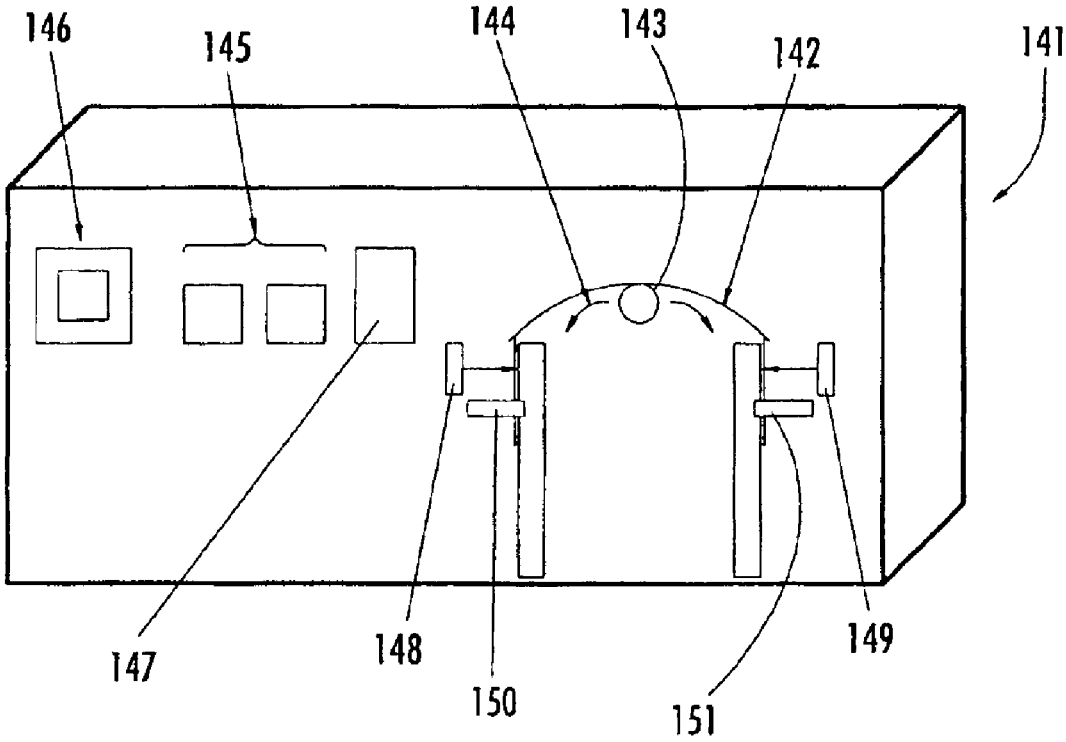
FIG. 4 is a perspective view of a machine used to measure slough of a paper sample.

FIG. 4 shows a diagram of the test equipment that may be employed to abrade a sheet. In FIG. 3, a machine 141 having a mandrel 143 receives a tissue sample 142. A sliding magnetic clamp 148 with guide pins (not shown) is positioned opposite a stationary magnetic clamp 149, also having guide pins (150–151). A cycle speed control 147 is provided, with start/stop controls 145 located on the upper panel, near the upper left portion of FIG. 4. A counter 146 is shown on the left side of machine 141, which displays counts or cycles.

In FIG. 4, the mandrel 143 used for abrasion may consist of a stainless steel rod, about 0.5" in diameter with the abrasive portion consisting of a 0.005" deep diamond pattern extending 4.25" in length around the entire circumference of the rod. The mandrel 143 is mounted perpendicular to the face of the machine 141 such that the abrasive portion of the mandrel 143 extends out from the front face of the machine 141. On each side of the mandrel 143 are located guide pins 150–151 for interaction with sliding magnetic clamp 148 and stationary magnetic clamp 149, respectively. These sliding magnetic clamp 148 and stationary magnetic clamp 149 are spaced about 4" apart and centered about the mandrel 143. The sliding magnetic clamp 148 and stationary magnetic clamp 149 are configured to slide freely in the vertical direction.

Using a die press with a die cutter, specimens are cut into 3" wide×8" long strips with two holes at each end of the sample. For tissue samples, the Machine Direction (MD)

corresponds to the longer dimension. Each test strip is weighed to the nearest 0.1 mg. Each end of the sample 142 is applied upon the guide pins 150–151 and sliding magnetic clamp 148 and stationary magnetic clamp 149 to hold the sample 142 in place.

The mandrel 143 is then moved back and forth at an approximate 15 degree angle from the centered vertical centerline in a reciprocal horizontal motion against the test strip for 20 cycles (each cycle is a back and forth stroke), at a speed of about 80 cycles per minute, removing loose fibers from the web surface. Additionally the spindle 143 rotates counter clockwise (when looking at the front of the instrument) at an approximate speed of 5 revolutions per minute (rpm). The sliding magnetic clamp 148 and stationary magnetic clamp 149 then are removed from the sample 142. Sample 142 is removed by blowing compressed air (approximately 5–10 psi) upon the sample 142.

The sample 142 is weighed to the nearest 0.1 mg and the weight loss calculated. Ten test samples per tissue sample may be tested and the average weight loss value in milligrams is recorded. The result for each example was compared with a control sample containing no hairspray.

EXAMPLE 1

Control Sample Unrefined Fibers

Creping Pocket Angle of 82 Degrees

A soft tissue product to be used as control was made using a creping pocket angle of about 82 degrees, using unrefined fibers, as further described below. A layered headbox was employed. The first stock layer contained eucalyptus hardwood fiber, which made up about 65% of the sheet by weight. This layer is the first layer to contact the forming fabric. Because it is transferred to a carrier felt, the hardwood layer also is the layer that contacts the drying surface. The second stock layer contained northern softwood fiber (designated LL-19). It comprised about 35% of the sheet by weight.

Permanent wet strength agent (Kymene, available from Hercules, Inc) was added in an amount equivalent to about 4 lbs/ton (about 0.2%) to the eucalyptus fiber and LL-19. The LL-19 fiber was not subjected to refining. A dry strength agent (Parez from Cytec) was added to the softwood side stock pump to adjust tensile strength. The machine speed of the 24-inch wide sheet was about 3000 feet per minute. The creping pocket angle was about 82 degrees. This tissue was plied together and calendered with two steel rolls at 30 pounds per lineal inch. This 2-ply product employed the dryer/softer eucalyptus layer plied to the outside of the product. The tissue was subjected to tensile test, slough test and panel softness evaluations.

EXAMPLE 2

Refined Fibers

Creping Pocket Angle of 82 Degrees

A tissue sample was prepared as in Example 1, except that the LL-19 fiber fraction was subjected to refining with about 1.5 horsepower-day per ton of dry fiber (HPD/T) energy input.

EXAMPLE 3

Refined Fibers

Creping Pocket Angle of 82 Degrees

A tissue sample was prepared as in Example 1, except that the LL-19 was subjected to refining with about 3.0 HPD/T energy input.

EXAMPLE 4

Refined Fibers

Creping Pocket Angle of 82 Degrees

A tissue sample was prepared as in Example 1, except that the LL-19 was subjected to refining with about 6.0 HPD/T energy input.

EXAMPLE 5

Refined Fibers

Creping Pocket Angle of 75 Degrees

A tissue sample was prepared as in Example 1, except that the LL-19 was subjected to refining with about 3.0 HPD/T energy input and a pocket creping angle of about 75 degrees.

EXAMPLE 6

Refined Fibers

Creping Pocket Angle of 75 Degrees

A tissue sample was prepared as in Example 1, except that the LL-19 was subjected to refining with about 6.0 HPD/T energy input and a pocket creping angle of about 75 degrees.

TABLE 1

Strength, Slough, and Stiffness Properties

| Example | HPD/T of Dry LL-19 Fiber | Creping Angle | Geometric Mean Tensile Strength (GMT) | Slough (milli-grams) | Panel Stiffness |
|---|---|---|---|---|---|
| 1 (unrefined) | 0 | 82 | 660 | 12.5 | 3.4 |
| 2 (refined) | 1.5 | 82 | 629 | 13.2 | 3.3 |
| 3 (refined) | 3 | 82 | 639 | 12.4 | 3.5 |
| 4 (refined) | 6 | 82 | 708 | 9.7 | 3.8 |
| 5 (refined) | 3 | 75 | 658 | 11.23 | 3.3 |
| 6 (refined) | 6 | 75 | 669 | 10.27 | 3.5 |

When comparing Example 1 with Examples 2–4, it can be seen that employing refined fibers having an increasing amount of refinement, at a given creping angle, tends to decrease the amount of tissue slough that is observed. This decreased slough coincides with only a relatively minor loss in softness.

Furthermore, comparing Examples 5 and 6 with Examples 3 and 4, respectively, shows that using refined fibers in combination with a 75 degree closed pocket creping angle produces a tissue product having, in general, better slough and softness properties.

Refining may reduce slough from tissue products, even though softness also may be adversely affected. Closed pocket creping at less than about 82 degrees combined with heavily refined softwood tends to produce a softer tissue with less slough.

EXAMPLE 7

Refined Fibers

Creping Pocket Angle of 80 Degrees

A tissue sample was prepared as in Example 1, except that the creping pocket angle was about 80 degrees and the LL-19 fiber fraction was subjected to refining with about 1.5 horsepower-day per ton of dry fiber (HPD/T) energy input.

EXAMPLE 8

Refined Fibers

Creping Pocket Angle of 80 Degrees

A tissue sample was prepared as in Example 7 (angle of about 80 degrees), except that the LL-19 was subjected to refining with about 3.0 HPD/T energy input.

EXAMPLE 9

Refined Fibers

Creping Pocket Angle of 80 Degrees

A tissue sample was prepared as in Example 7 (angle of about 80 degrees), except that the LL-19 was subjected to refining with about 6.0 HPD/T energy input.

EXAMPLE 10

Refined Fibers

Creping Pocket Angle of 78 Degrees

A tissue sample was prepared as in Example 1, except that the creping pocket angle was about 78 degrees and the LL-19 was subjected to refining with about 1.5 HPD/T energy.

EXAMPLE 11

Refined Fibers

Creping Pocket Angle of 78 Degrees

A tissue sample was prepared as in Example 10, except that the LL-19 was subjected to refining with about 3.0 HPD/T energy.

EXAMPLE 12

Refined Fibers

Creping Pocket Angle of 78 Degrees

A tissue sample was prepared as in Example 10, except that the LL-19 was subjected to refining with about 6.0 HPD/T energy.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A method of manufacturing a tissue product comprising the following steps:

(a) providing a first papermaking furnish containing softwood fibers mechanically refined with an energy of greater than about 1.5 horsepower-day per ton;

(b) providing a second papermaking furnish containing hardwood fibers;

(c) incorporating the first and second papermaking furnishes into a tissue web such that the tissue web has a hardwood layer and a softwood layer;

(d) contacting the tissue web with a drying surface so that the hardwood layer is disposed adjacent thereto; and (e) removing the tissue web from the drying surface with a creping blade at a creping pocket angle of less than about 82 degrees.

2. The method of claim 1 wherein the hardwood layer and the softwood layer are formed using a multi-layered headbox.

3. The method of claim 1 in which the softwood fibers are mechanically refined with an energy of greater than about 3.0 horsepower-day per ton.

4. The method of claim 1 in which the softwood fibers are mechanically refined with an energy of greater than about 6.0 horsepower-day per ton.

5. The method of claim 1 in which the creping pocket angle is less than about 80 degrees.

6. The method of claim 1 in which the creping pocket angle is less than about 78 degrees.

7. The method of claim 1 in which the creping pocket angle is less than about 75 degrees.

8. The method of claim 1 in which the creping pocket angle is about 75 degrees.

9. The method of claim 1, in which the hardwood layer comprises a debonder.

10. The method of claim 1 in which the hardwood layer defines an outer surface of the tissue product.

11. A method of manufacturing a tissue product comprising the following steps:

(a) providing a papermaking furnish containing softwood fibers, wherein said softwood fibers are mechanically refined with an energy of greater than about 3.0 horsepower-day per ton;

(b) providing a papermaking furnish containing hardwood fibers;

(c) depositing the softwood and hardwood furnishes onto a forming surface using a multi-layered headbox box to form a tissue web having a hardwood layer and a softwood layer;

(d) contacting the tissue web with a drying surface so that the hardwood layer is disposed adjacent thereto; and (e) removing the tissue web from the drying surface with a creping blade at a creping pocket angle of less than about 80 degrees, wherein the hardwood layer defines an outer surface of the resulting tissue product.

12. The method of claim 11 in which the softwood fibers are mechanically refined with an energy of greater than about 6.0 horsepower-day per ton.

13. The method of claim 11 in which the creping pocket angle is less than about 78 degrees.

14. The method of claim 11 in which the creping pocket angle is less than about 75 degrees.

15. The method of claim 11, in which the hardwood layer comprises a debonder.

* * * * *